US011090540B2

(12) United States Patent
Voss

(10) Patent No.: US 11,090,540 B2
(45) Date of Patent: Aug. 17, 2021

(54) GAME SYSTEMS AND METHODS OF USE THEREOF

(71) Applicant: David Voss, Burns Harbor, IN (US)

(72) Inventor: David Voss, Burns Harbor, IN (US)

( * ) Notice: Subject to any disclaimer, the term of this patent is extended or adjusted under 35 U.S.C. 154(b) by 0 days.

(21) Appl. No.: 15/016,720

(22) Filed: Feb. 5, 2016

(65) Prior Publication Data

US 2017/0113112 A1 Apr. 27, 2017

Related U.S. Application Data

(60) Provisional application No. 62/245,479, filed on Oct. 23, 2015.

(51) Int. Cl.
*A63B 67/06* (2006.01)

(52) U.S. Cl.
CPC ..... *A63B 67/06* (2013.01); *A63B 2067/063* (2013.01); *A63B 2210/50* (2013.01)

(58) Field of Classification Search
CPC ..... A63B 67/06; A63B 2067/063
See application file for complete search history.

(56) References Cited

U.S. PATENT DOCUMENTS 3,701,531 A * 10/1972 Bowers ..... A63B 67/06 273/343
4,203,592 A 5/1980 Quatkemeyer
4,938,485 A 7/1990 Hockridge et al.
4,943,065 A 7/1990 DeLapa
4,961,586 A 10/1990 Conville
5,056,796 A 10/1991 Conville
5,165,694 A * 11/1992 Kraushaar ..... A63B 67/06 273/343
5,165,695 A 11/1992 Yoder
5,871,216 A 2/1999 Sparacino
5,909,877 A 6/1999 Bour
6,244,598 B1 6/2001 Conville
6,308,956 B1 * 10/2001 Reid ..... A63B 43/007 273/343
6,932,345 B1 8/2005 O'Dell
7,198,273 B1 * 4/2007 Advocate ..... A63B 43/007 273/343
D544,041 S 6/2007 Murphy et al.
7,237,777 B2 7/2007 Digges, III et al.
7,314,420 B2 1/2008 Konstant
7,328,902 B1 2/2008 White et al.
7,607,666 B1 10/2009 Studier
7,703,771 B2 4/2010 Hunt et al.
7,802,795 B2 9/2010 Bos
(Continued)

*Primary Examiner* — Raleigh W Chiu
(74) *Attorney, Agent, or Firm* — Hartman Global IP Law; Gary M. Hartman; Domenica N.S. Hartman

(57) ABSTRACT

Game systems and methods of use thereof. Such a game system includes a pair of game boards each having a platform that defines an inclined surface, a pair of stakes each configured to protrude from one of the surfaces of the game boards, and at least two sets of game pieces, each game piece having two weighted tossable objects tethered to one another by a connecting member, each set of game pieces being readily identifiable from the other. A game may be played by tossing the game pieces towards the surfaces of the platforms and calculating a score based on the interaction between the game pieces and the stakes of the game boards and their surfaces, wherein the game ends when a predetermined total score is reached.

10 Claims, 8 Drawing Sheets

(56) References Cited

U.S. PATENT DOCUMENTS

| | | | | |
|---|---|---|---|---|
| 8,157,265 | B2 | 4/2012 | Conville et al. | |
| 8,979,091 | B2 * | 3/2015 | Darragh | A63B 67/06 273/343 |
| 2008/0116644 | A1 * | 5/2008 | Knoernschild | A63B 67/06 273/336 |
| 2008/0157476 | A1 * | 7/2008 | Striebel | A63B 63/00 273/402 |
| 2009/0278317 | A1 * | 11/2009 | Lima | A63B 65/00 273/343 |
| 2010/0176554 | A1 * | 7/2010 | Godwin | A63B 67/06 273/338 |
| 2010/0181726 | A1 * | 7/2010 | Bos | A63B 67/06 273/336 |
| 2013/0082442 | A1 * | 4/2013 | Hanel | A63B 63/00 273/398 |
| 2013/0118950 | A1 * | 5/2013 | Parham | A63B 67/06 206/579 |
| 2014/0091526 | A1 * | 4/2014 | Nally | A63B 63/08 273/402 |
| 2014/0117621 | A1 * | 5/2014 | Darragh | A63B 67/06 273/343 |
| 2015/0054221 | A1 * | 2/2015 | Sandman | A63B 67/06 273/402 |
| 2016/0023095 | A1 * | 1/2016 | Nally | A63B 67/06 273/343 |
| 2016/0074726 | A1 * | 3/2016 | Silva | A63B 67/06 273/336 |
| 2016/0082334 | A1 * | 3/2016 | Olive | A63B 67/06 108/19 |
| 2016/0256758 | A1 * | 9/2016 | Riniti | A63B 67/06 |
| 2017/0113112 | A1 * | 4/2017 | Voss | A63B 67/06 |
| 2017/0138586 | A1 * | 5/2017 | Finch | F21V 33/008 |

* cited by examiner

GAME SYSTEMS AND METHODS OF USE THEREOF

CROSS REFERENCE TO RELATED APPLICATIONS

This application claims the benefit of U.S. Provisional Application No. 62/245,479, filed Oct. 23, 2015, the contents of which are incorporated herein by reference.

BACKGROUND OF THE INVENTION

The present invention generally relates to entertainment games. The invention particularly relates to a recreational toss game in which objects are thrown at a game board and points are scored according to the interaction between the thrown objects and the game board.

Recreational toss games have been known for many years and include various types of game pieces and rules of play. Examples include toss games such as traditional horseshoes where metal horse shoes are thrown at stakes protruding from the ground, more contemporary horseshoe-type games such as disclosed in U.S. Pat. No. 7,802,795 to Bos, bag tossing games such as those disclosed in U.S. Pat. No. 4,943,065 to DeLapa, U.S. Pat. No. 4,961,586 to Conville, and U.S. Pat. No. 5,871,216 to Sparacino, and tethered ball tossing games such as those disclosed in U.S. Pat. No. 6,308,956 to Reid, U.S. Pat. No. 7,328,902 to White, and U.S. Pat. No. 7,703,771 to Hunt et al.

While many recreational toss games are already known, a recent increase in popularity of such games has created an ongoing demand for new types of toss games.

BRIEF DESCRIPTION OF THE INVENTION

The present invention provides recreational toss game systems and methods of play thereof in which objects are thrown at a game board and points are scored according to the interaction between the thrown objects and the game board.

According to one aspect of the invention, a recreational toss game system includes a pair of game boards each having a platform that defines an inclined surface, a pair of stakes each configured to protrude from one of the surfaces of the game boards, and at least two sets of game pieces, each of the game pieces comprising two weighted tossable objects tethered to one another by a connecting member, each set of game pieces being readily identifiable from the other.

According to another aspect of the invention, a method is provided for playing a recreational toss game system with a pair of game boards each having a platform that defines a surface having a stake protruding therefrom, and at least two sets of game pieces. The method includes tossing the game pieces toward the surfaces of the platforms, calculating a score based on the interaction between the game pieces and the stakes of the pair of game boards and the surfaces, and terminating the game when a predetermined total score is reached.

Technical effects of the game systems and methods of play described above preferably include the ability to provide entertainment that combines challenges of the types presented by conventional games such as bag toss (cornhole), tethered ball toss (ladder ball), and horseshoe-type games.

Other aspects and advantages of this invention will be better appreciated from the following detailed description.

DETAILED DESCRIPTION OF THE INVENTION

Figure 1:
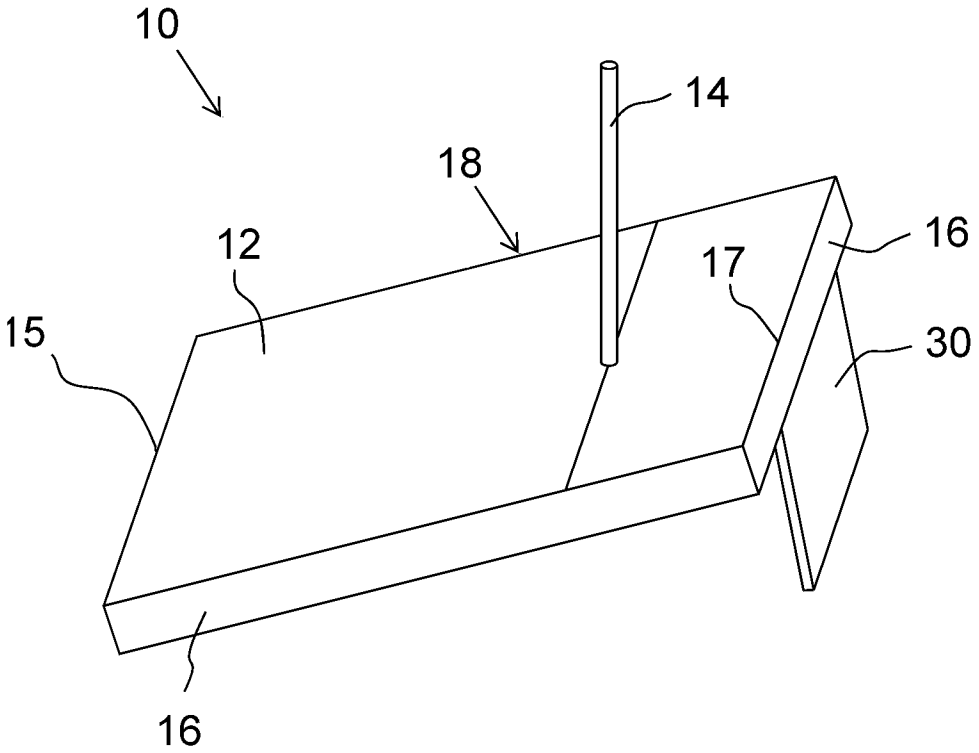
FIG. 1 schematically represents a perspective view of a nonlimiting example of a game board in an upright orientation with a stake secured thereto suitable for playing a recreational toss game according to certain aspects of the invention.

The present invention generally relates to a recreational toss game meant to entertain and bring enjoyment to many. FIGS. 1-9 represent nonlimiting examples of portable game boards and pieces that together constitute a game system that may be used to play the game. While specific game boards and pieces are shown for the game system, it is foreseeable that functionally-equivalent structures could be used to play the game, such as game boards and pieces having different sizes, shapes, marks, and materials.

Referring to FIGS. 1-9, a nonlimiting example of the game board 10 includes a planar surface 12 and sides 16 of a platform 18. A single hole 32 is provided through the surface 12 of the platform 18. The sides 16 of the platform 18 define a cavity 50 on an underside of the platform 18. A support 40 is located in the cavity 50 below the hole 32 and covers the hole 32 on the underside of the platform 18. A stake 14 or other rod-like body is provided and configured to have a lowermost end of the stake 14 removably inserted into the hole 32 and retained therein such that the remainder of the stake 14 protrudes upwards above the surface 12 of the platform 18. In the embodiment represented in FIG. 1-7, once inserted into the hole 32 the lowermost end of the stake 14 contacts the support 40 which consequently supports the stake 14 in its upright position. Although represented as being retained and supported by the support 40, the stake 14 may be retained and supported within the hole 32 by any means known in the art. For example, the stake 14 may include an outer circumference that is tapered such that only its lowermost end has a circumference capable of being inserted into the hole 32 and other portions of the stake 14 have outer circumferences large enough to be supported by uppermost edges of the hole 32, or the hole 32 may not be formed entirely through the surface 12 and instead define a blind hole or cavity in the surface 12 complimentary to the lowermost end of the stake 14. For convenience, the platform 18 will be referred to as comprising a front end 15 and a rear end 16 and having a front-rear direction therebetween and a side-to-side direction perpendicular to the front-rear direction. Preferably, the hole 32 for the stake 14 is located in a position that is generally centered across a width of the surface 12 (side-to-side direction) and further towards the rear end 17 of the platform 18 than the front end 15.

Figure 2:
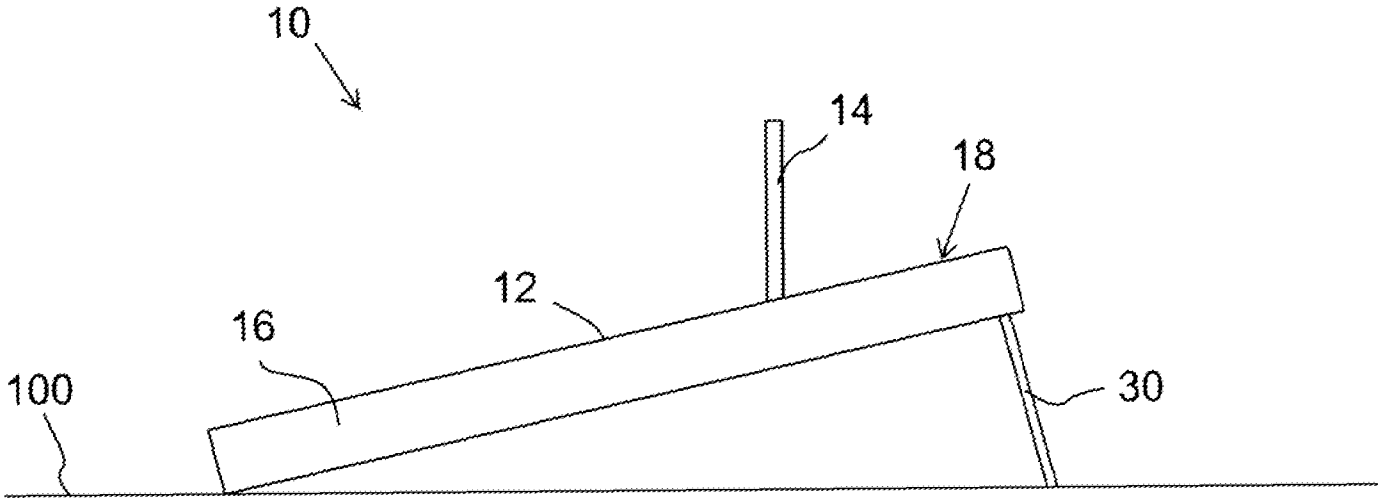
FIG. 2 schematically represents a side view of the game board of FIG. 1 in an upright position.
Figure 4:
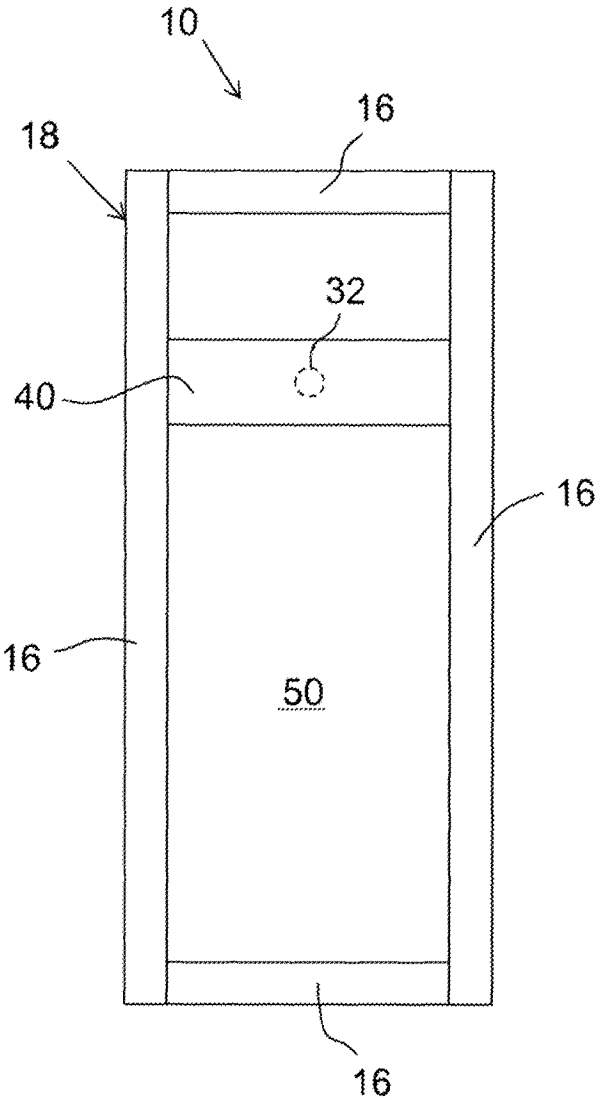
FIG. 4 schematically represents a bottom view of the game board of FIG. 1, excluding a folding leg and fasteners used to hold the stake for storage.
Figure 3:
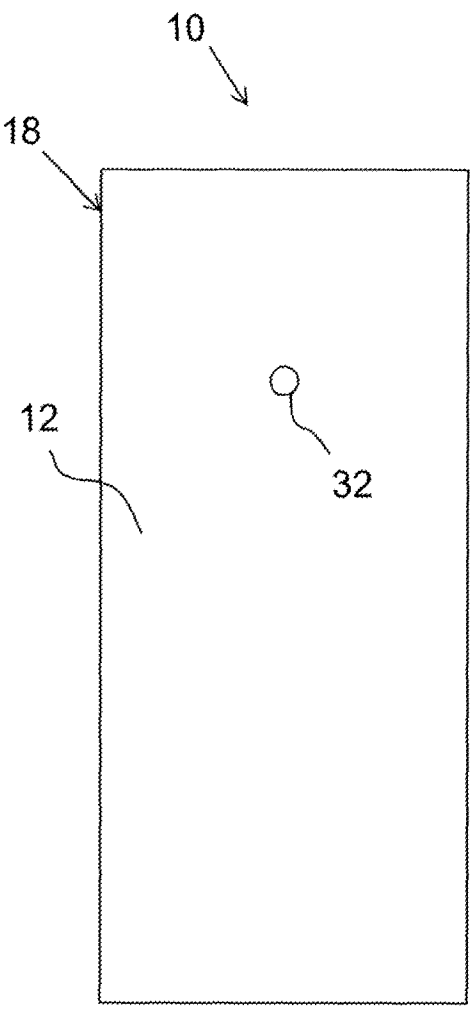
FIG. 3 schematically represents a top view of a game surface of the game board of FIG. 1 excluding the stake.

As will be described hereinafter, the game is preferably performed using a pair of the game boards 10. During the game, the surfaces 12 of the game boards 10 are preferably inclined at an acute angle to horizontal (earth, ground, or other surface beneath and supporting the game boards 10, hereinafter, "ground" 100), for example, twenty to forty degrees. To this end, the game boards 10 preferably include legs, sides 16 with tapered bottom edges, or other means for supporting the game boards 10 such that the surface 12 of each board 10 is inclined, with a front edge of the surface 12 of the platform 18 (at the front end 15) being lower than its oppositely-disposed rear edge (at the rear end 17). For example, FIGS. 1, 2, and 5-7 represent the game board 10 as including a single supporting leg 30 near the rear end 17 of the platform 18. The leg 30 is configured to raise the rear end 17 of the platform 18 such that the platform's surface 12 has the desired inclination relative to the ground 100 beneath the board 10. In this nonlimiting embodiment, the front end 15 of the platform 18 does not include supporting legs, and instead rests directly on the ground 100. However, it is foreseeable that the game board 10 could include any number of supporting legs located at any number of locations on the platform 18. According to one nonlimiting example, each game board 10 may be set up such that the rearmost edge of surface 12 is approximately twelve inches (about 30 cm) off of the ground 100. In addition, during the game each stake 14 is located within a respective hole 32 and secured to its game board 10 so as to be vertical or at least nearly vertical relative to horizontal (i.e., as determined by the ground 100 beneath and supporting the game boards 10) as represented in FIGS. 2 and 8. Since the game boards 10 are inclined relative to horizontal, it is necessary that the stake 14 protrudes from the surface 12 at an angle that is not perpendicular to the surface 12. This aspect may be accomplished in any suitable matter. Nonlimiting examples include creating the hole 32 so that its axis is at an angle other than perpendicular the surface 12, or creating the stake 14 to comprise a bend or curve at the lowermost end thereof such that the remainder of the stake 14 protruding from the surface 12 is vertical or at least nearly vertical relative to horizontal.

Figure 5:
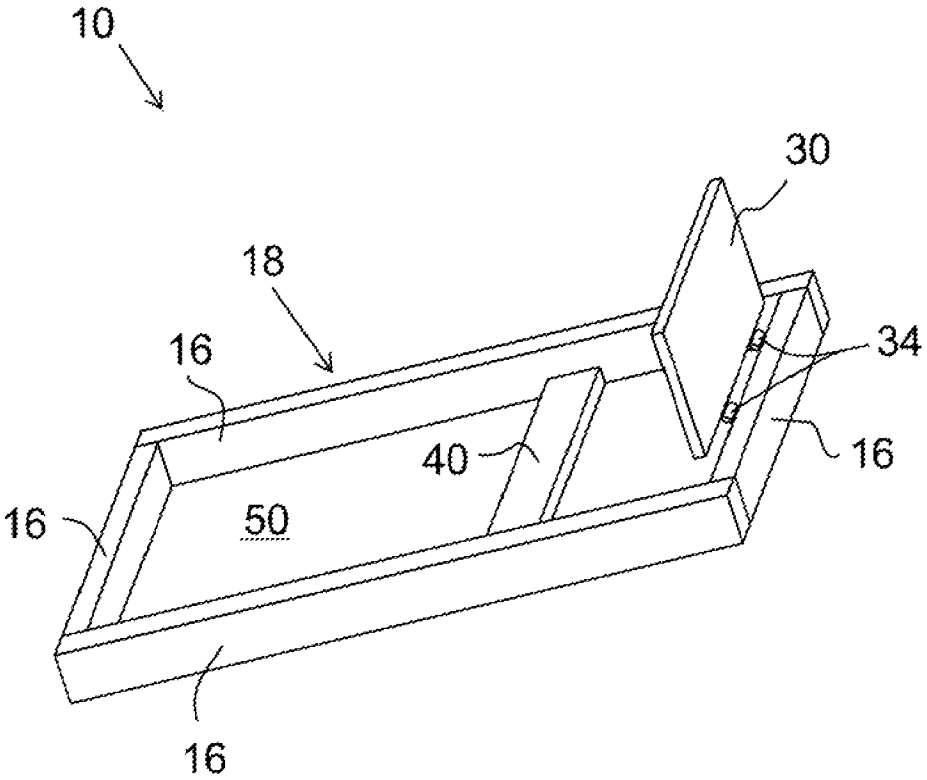
FIG. 5 schematically represents a perspective view of the game board of FIG. 1 in an upside-down orientation, and shows a folding leg connected to the game board by two hinges. The folding leg folds in for storage and folds out to set a rear end of the game board at a certain height off the ground.
Figure 6:
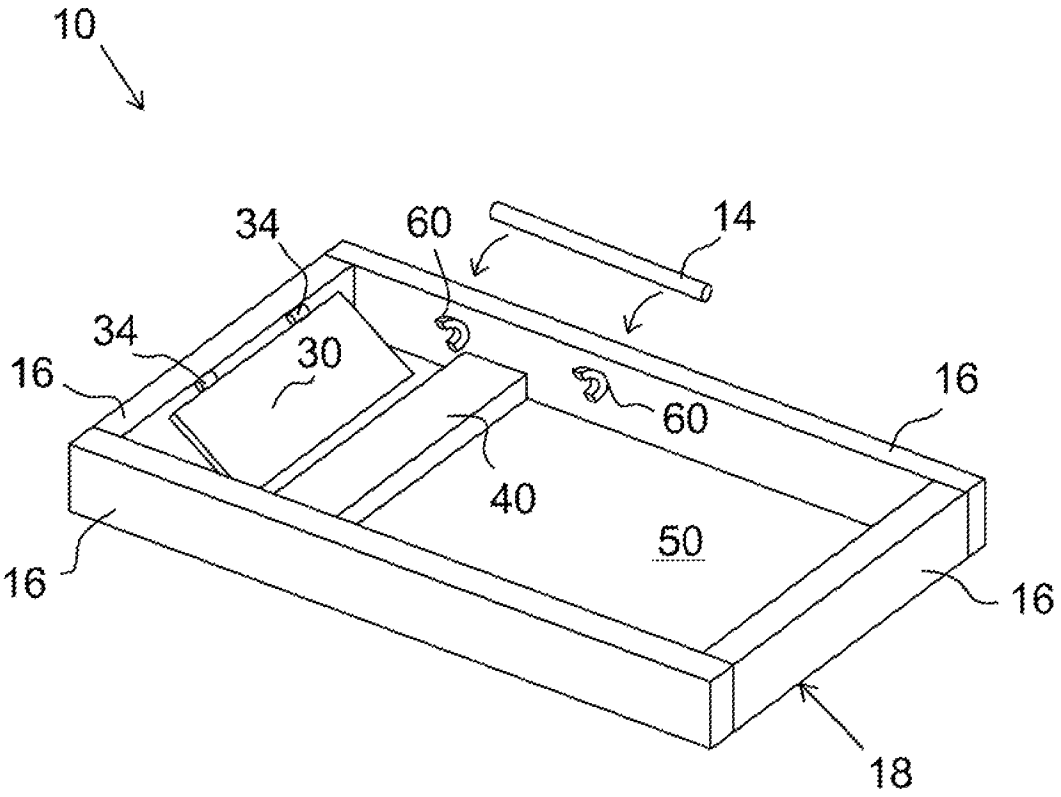
FIG. 6 schematically represents a perspective view of the game board of FIG. 1 in an upside-down orientation, and shows a nonlimiting example of how the folding leg of the game board can be stowed when the game board is not in use. Two fasteners are located on one side of the game board to secure the stake.
Figure 7:
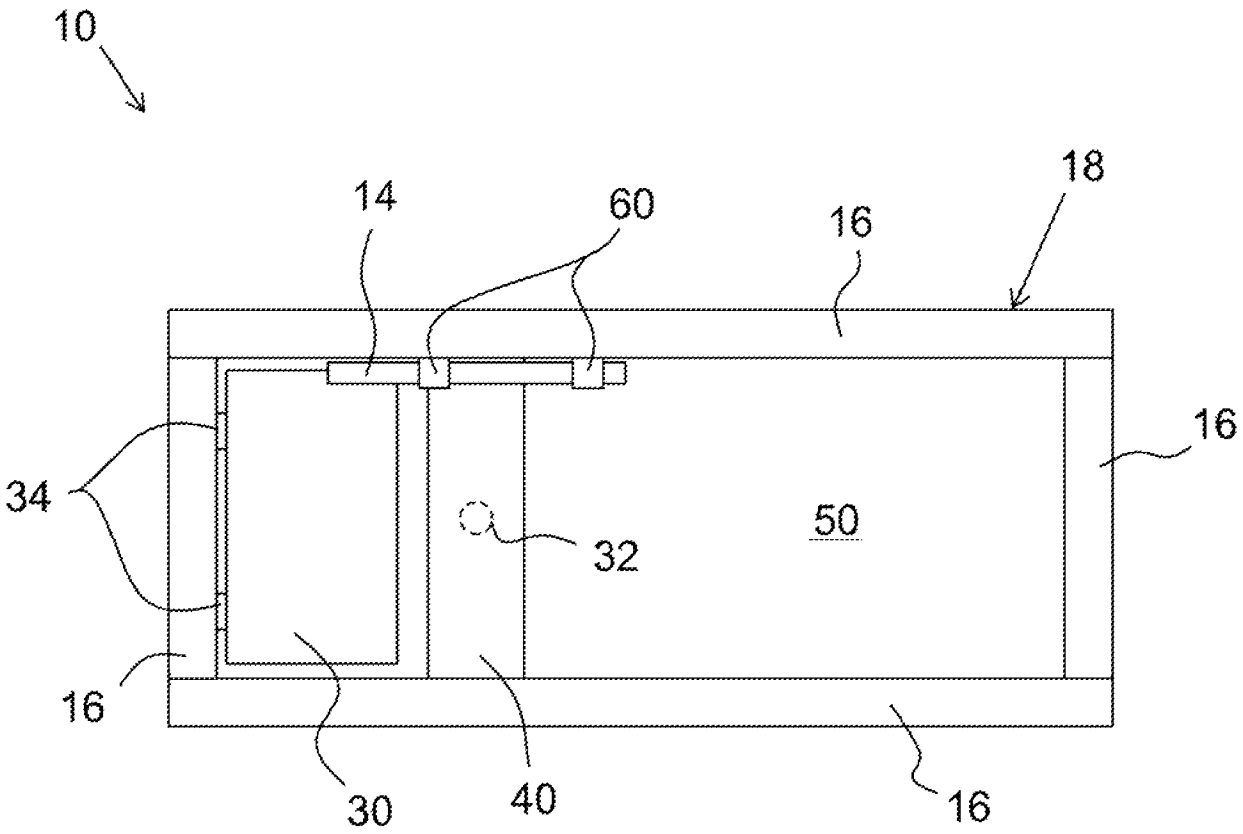
FIG. 7 schematically represents a bottom view of the game board of FIG. 1, in an upside-down orientation, and shows a nonlimiting example of how the folding leg of the game board can be stowed and secured by the stake when the game board is not in use. When secured with the fasteners, the stake may be positioned so that when the folding leg is folded in completely to its stowed position, one end of the stake rests against the leg to hold the leg in place while transporting the game board.
Figure 8:
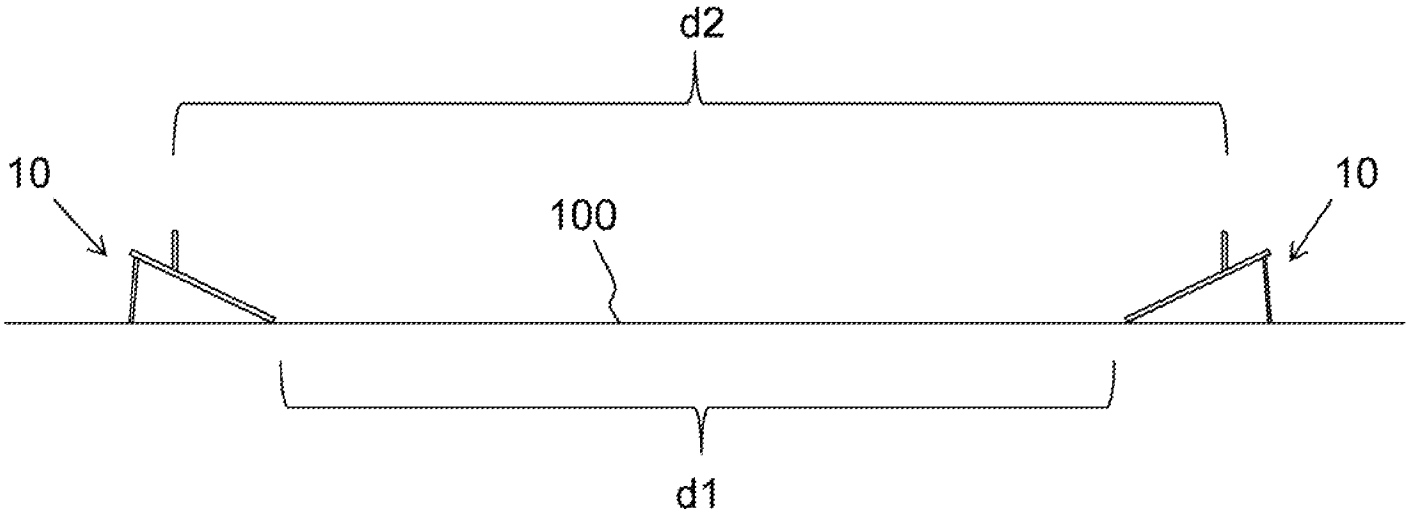
FIG. 8 schematically represents a nonlimiting example of how two game boards of the type shown in FIG. 1 can be arranged for use.

FIGS. 5, 6, and 7 represent the supporting leg 30 as being capable of pivoting about the rear end 17 of the platform 18 such that the supporting leg 30 may be stowed and stored within the cavity 50 on the underside of the platform 18. In the nonlimiting embodiment shown, the pivoting capability is provided by hinges 34. Fasteners 60 such as but not limited to clips or clamps are provided on an inside of one of the sides 16 of the platform 18 to provide means for storing the stake 14 within the cavity 50 of the underside of the platform 18. According to one embodiment of the invention, FIG. 7 shows that the stake 14 may be stored in a manner such that a portion of the stake 14 provides a barrier that prevents the supporting leg 30 from pivoting from within the underside of the platform 18. Such an arrangement provides for securing the leg 30 in the cavity 50 without the need for additional components. The platform 18, leg 30, and stake 14 of the game board 10 may be formed of any material, nonlimiting examples including wood, metal, composite, and polymer materials.

Figure 9:
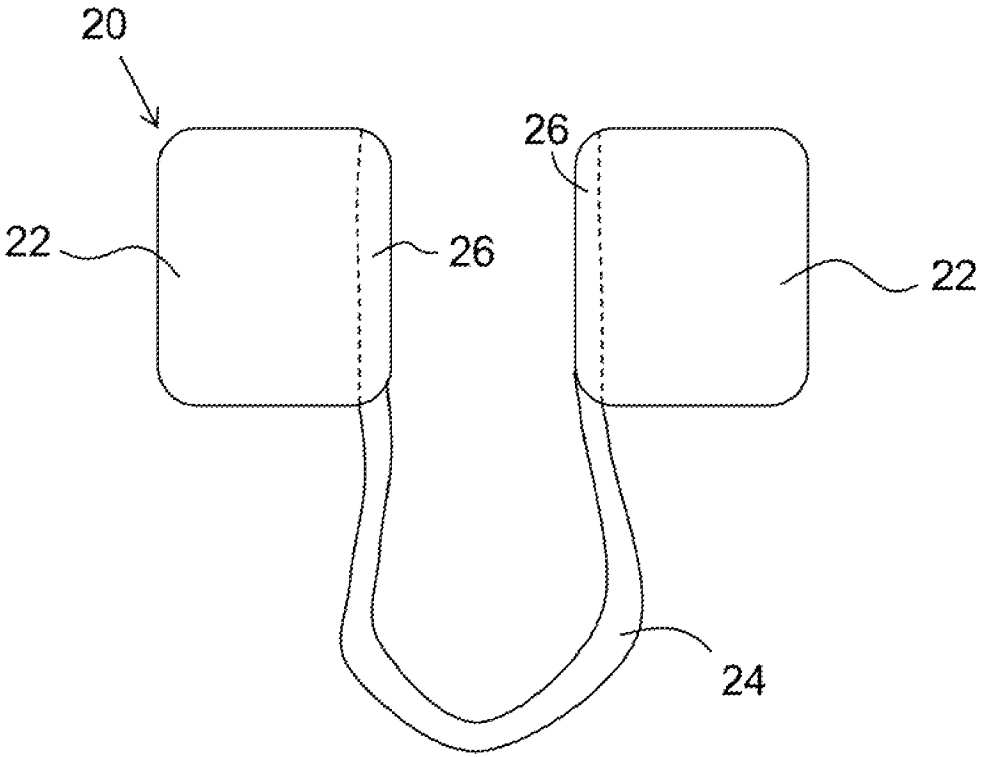
FIG. 9 schematically represents a nonlimiting example of a game piece that may be used with the game boards of FIG. 1 to play a recreational toss game in accordance with certain aspects of the invention.

According to a preferred aspect of the invention, the game system further comprises tethered game pieces 20 used by players during the game to interact with the game boards 10 according to a set of game rules or rules of play in order to score points to win the game. FIG. 9 represents a game piece 20 as including a pair of bags (or any other weighted tossable objects) 22 tethered to one another by a flexible connecting member 24. As a nonlimiting example, the bags 22 may include a small fabric bag or other container filled with a granular filler material such as but not limited to beads, sand, or corn. Nonlimiting examples of the connecting member 24 include rope, cord, or any other pliable material capable of retaining the pair of bags 22 to one another while freely allowing movement of the bags 22 relative to each other and to the connecting member 24. Although in the nonlimiting embodiment shown the bags 22 are represented as relatively square-shaped pillow-like articles, it will be understood that the bags 22 may have any suitable external shape. In general, players toss the game pieces 20 toward the surface 12 of each game board 10 in an attempt to wrap the connecting members 24 of the game pieces 20 around the stake 14 or have the game pieces 20 land and remain on the surface 12 of the game board 10, which results in two different ways to score points. In order for an individual player or team of players to win the game, the player or team must obtain a predetermined total number of points scored, for example, twenty-one points.

Nonlimiting aspects of the rules of the game will now be described in reference to the game boards 10 and the game pieces 20 shown in the drawings. While the game procedure described below is believed to be preferred, other variations of play are foreseeable and within the scope of the invention. The game is preferably played with two game boards 10 and two or more sets of separately identifiable game pieces 20. Prior to playing the game, the game boards 10 are placed at a predetermined distance from one another with the front edge of each game board surface 12 facing one another, for example, approximately 21 feet from the front edge of one board 10 to the front edge of the other game board 10 resulting in a fixed distance between both stakes 14, for example approximately 27 feet, represented in FIG. 8 as distances d1 and d2, respectively. The game boards 10 are arranged such that their surfaces 12 are at an incline relative to horizontal, and their stakes 14 are secured to the game boards 10 so as to be approximately vertical relative to earth. In the following nonlimiting examples, the rules of the game will be described as played between two teams of players, each team using one of two sets of game pieces 20, each set comprising four game pieces 20 comprising bags 22 that are a different color (or different combination of colors) from the other set of game pieces 20 for identification between the two sets. However, the rules may be modified to accommodate any number of players, teams, sets of game pieces 20, or number of game pieces 20 within a set.

Upon the start of the game, each player preferably stands anywhere behind a foul line coinciding with the front end 15 of the platform 18 or another location relative to their respective game boards 10. The players choose a team that will toss first. The players individually toss their respective game pieces 20 toward the surface 12 of the game board 10 opposite from the game board 10 at which they stand. Players will alternate turns until all game pieces 20 are tossed. All tossing is preferably underhand only. In general, all game pieces 20 previously thrown which stay on the surfaces 12 of the game boards 10 remain in place as subsequent game pieces 20 are thrown such that it is possible that subsequently thrown game pieces 20 may interact with previously thrown game pieces 20. Once all game pieces 20 are tossed, a round is over and points are totaled based on the game pieces 20 remaining on the surfaces 12. If the total score of both teams is below the predetermined total score, for example twenty-one points, a subsequent round will begin, repeating the above process. The team that wins an individual round by accumulating the most points preferably tosses first at the start of the next round. If a round results in a tie and no points are awarded (as explained hereinafter), the team that tossed first in the previous round preferably tosses first again. Game play continues until a team reaches the score of the predetermined total score.

Team scoring for tossed game pieces 20 may be tallied as follows. Zero points are awarded for an individual game piece 20 that does not land on the surface 12 of the game board 10 or if the toss is considered a "dead throw." A dead throw may occur if a game piece 20 bounces off of the ground 100 and then lands on the surface 12 of the game board 10, or the player tossing the individual game piece 20 steps across the foul line of their respective game board 10 during their toss, regardless of where the game piece 20 lands. In these instances, the individual thrown game pieces 20 are removed from the game board 10 prior to remaining tosses, and do not count toward the score. In addition, if a game piece 20 lands on the surface 12 of the game board 10 such that one of its bags 22 is on the surface 12 and the other bag 22 is hanging off an edge of the surface 12 and is touching the ground 100, the toss is considered a dead throw. However, in this instance while the game piece 20 does not count toward the score, it is not removed from the game board 10 until all game pieces 20 have been tossed and points are totaled. One point is awarded for an individual game piece 20 that lands on the surface 12 of the game board 10 and both bags 22 remain on the surface 12 of the game board 10, or for a game piece 20 that lands on the surface 12 of the game board 10 and one bag 22 is on and the other bag 22 is hanging off the edge, but not touching the ground 100, that is, the other bag 22 is suspended in the air. Three points are awarded for an individual game piece 20 that is tossed and makes a "ringer." A ringer may occur if an individual game piece 20 is tossed and the connecting member 24 wraps around the stake 14 and remains around the stake 14, or if a game piece 20 slides up the game board 10 and both bags 22 pass a line (FIG. 1) that extends across the surface 12 in the side-to-side direction and passes through the stake 14 (for example, parallel to the front and rear edges of the surface 12). In the instance of both bags 22 passing this line, the connecting member 24 is not required to wrap around the stake 14; however, this type of ringer requires that both teams agree that the game piece 20 results in a ringer at the time of totaling points.

The value or points awarded by each of the individual game pieces 20 are not counted until the end of each round. Consequently, interaction between game pieces 20 during a round may change the potential value of an individual game piece 20. For example, if a game piece 20 is laying on the surface 12 of the game board 10 in position to score one point, but is pushed up (toward the rear end 17 of) the surface 12 by any subsequently-thrown game pieces 20 so that it crosses the line of the stake 14, the potential value of the pushed game piece 20 changes from one point to three points. Similarly, teams can also lose potential points during any round if their game piece 20 is in originally in a scoring position, but is subsequently pushed off of the surface 12 by later thrown game pieces 20, regardless of which team threw the later thrown game pieces 20. As a nonlimiting example of such instance, if a team has a first game piece 20 in position to score one point, and a second game piece 20 is subsequently tossed by either team and pushes one of the bags 22 of the first game piece 20 off the edge of the surface 12 such that it now touches the ground 100, the first game piece 20 is treated as if it was originally in this position upon being thrown. Therefore, the first game piece 20 remains on the surface 12 of the game board 10 until all game pieces 20 have been tossed, but will not count toward the total score for that round. Notably, it is possible that ringers can also be knocked out of a three-point scoring position and result in one point or zero points based on scoring at the end of the round.

After both teams have tossed all four of their game pieces 20, the players count how many points each team earned according to the rules of scoring. The team with the lower number of points subtracts their points from the total score of the points earned by the team with the higher number of points. The remaining points earned by the team with the higher number of points are added to their team's total score. As such, only one team can earn points per round. For example, if a first team scores six points and a second team scores four points, the first team wins that round and earns a score of two points by taking the first team's total of six points and subtracting the second team's total of four points, resulting in two points for that round. The first team then adds two points to their current total of points. Game play continues through subsequent rounds until the total score of a team reaches the predetermined score (e.g., twenty-one points). The team to reach the predetermined score first wins the game.

The above set of rules represents only one nonlimiting example of a method of playing the game with the game boards 10 and game pieces 20 shown in the drawings. It is foreseeable that the game rules may be altered or modified based on personal preference. Some variations include but are not limited to the requirement that a team must win by two points, a team can only win by scoring the predetermined score exactly without going over or the team returns to the score at the beginning of that round, or a team automatically wins if it earns a certain score (for example eleven points) before the opposing team scores any points. In one example, if the first team has twenty points and the second team has twenty points, either team could be required to score at least two points in a round bringing the total score to twenty-two points in order to win. In this instance, if either team only scored one point making the score 21-20, game play would continue past the predetermined score until one of the teams' total score is at least two more points than the opposing team at the end of a round. In another example, if the teams are required to obtain exactly twenty-one points to win and the first team has eighteen points and the second team has fourteen points, the first team would have to score three points or the second team would have to score seven points to win this round. In this instance, either team could bust on the round. For example, if the first team wins the round but is awarded four points for the round resulting in a total score of twenty-two, the first team would instead have to return to the previous score of eighteen since the score is above twenty-one and eighteen was their score at the beginning of the round. In such a case, the round is over and neither team earns any points toward their total scores. In yet another example, if the first team achieves a total score of eleven points or more and the second team has not scored any points toward their total score, the first team could be said to have "skunked" the second team. In this instance, the game would be over resulting with the first team as the victors.

In view of the above, games that can be played with the game system represented in the drawings provide entertainment that can be enjoyed by many individuals. Such games can combine challenges similar to those presented by conventional games such as bag toss (cornhole), tethered ball toss (ladder ball), and horseshoe-type games.

While the invention has been described in terms of specific embodiments, it is apparent that other forms could be adopted by one skilled in the art. For example, components of the game system and the physical configuration of the game boards 10 and game pieces 20 could differ from that shown, and materials and processes/methods other than those noted could be used. Therefore, the scope of the invention is to be limited only by the following claims.

The invention claimed is:

1. A method of playing a game with a game system supported on a ground surface and comprising a pair of game boards each having a platform that defines a planar surface that is inclined at an acute angle to horizontal and has only a single stake protruding therefrom that is centered across a width of the planar surface and further towards a rear end of the game board than a front end of the game board, and at least two sets of game pieces each comprising two weighted tossable objects tethered to one another by a flexible connecting member of a sufficient length to enable each of the game pieces to individually and completely wrap around the stake of one of the game boards and remain wrapped around the stake while the game piece lies on the planar surface and also to enable one of the two weighted tossable objects thereof to lie on the planar surface of one of the game boards and the other of the two weighted tossable objects to hang off an edge of the planar surface and touch the ground surface supporting the game board, the method comprising:

tossing the game pieces towards the planar surfaces of the platforms across front edges thereof and scoring points according to interactions between the game pieces and the game boards, including any one of the game pieces lands and remains on the planar surface of one of the game boards without interacting with the stake thereof, and the connecting member of any one of the game pieces partially or completely wraps around the stake protruding from any one of the planar surfaces and remains wrapped around the stake while the game piece lies on the planar surface, and one of the two weighted tossable objects of any one of the game pieces lies on the planar surface and the other of the two weighted tossable objects hangs off an edge of the planar surface and does not touch the ground surface supporting the game board;

calculating a score based on the interactions between the game pieces and the game boards; and terminating the game when a predetermined total score is reached.

2. The method according to claim 1, further comprising setting up the game boards by arranging at least one supporting leg secured to each of the platforms to raise a rear edge of the planar surface thereof such that the planar surface is upwardly sloped relative to the ground surface from the front edge to the rear edge of the planar surface prior to tossing the game pieces towards the planar surfaces.

3. The method according to claim 2, further comprising storing the at least one supporting leg of each of the game boards by pivoting the at least one supporting leg into a cavity on an underside of the platform thereof.

4. The method according to claim 1, wherein each of the stakes protrudes from one of the planar surfaces at an angle that is not perpendicular to the planar surface such that the stakes are substantially vertical relative to the ground surface.

5. The method according to claim 1, further comprising storing the stakes in a cavity on an underside of each of the platforms.

6. The method according to claim 1, further comprising:

storing at least one supporting leg secured to each of the platforms by pivoting the at least one supporting leg into a cavity on an underside of each of the platforms, the at least one supporting leg configured to raise a rear edge of the planar surface such that the planar surface is upwardly sloped relative to the ground surface from the front edge to the rear edge of the planar surface; and storing each of the stakes in the cavity on the underside of each of the platforms, wherein when the stake and the supporting leg are both stored in the cavity the stake secures the supporting leg within the cavity.

7. A method of playing a game with a game system supported on a ground surface and comprising a pair of game boards each having a platform that defines a planar surface that is inclined at an acute angle to horizontal and has only a single stake protruding therefrom that is centered across a width of the planar surface and further towards a rear end of the game board than a front end of the game board, and at least two sets of game pieces each comprising two weighted tossable objects tethered to one another by a flexible connecting member of a sufficient length to enable each of the game pieces to individually and completely wrap around the stake of one of the game boards and remain wrapped around the stake while the game piece lies on the planar surface and also to enable one of the two weighted tossable objects thereof to lie on the planar surface of one of the game boards and the other of the two weighted tossable objects to hang off an edge of the planar surface and touch the ground surface supporting the game board, the method comprising:

performing a series of rounds each including tossing the game pieces towards the planar surfaces of the platforms across front edges thereof until all game pieces have been tossed, and scoring points according to interactions between the game pieces and the game boards, including any one of the game pieces lands and remains on the planar surface of one of the game boards without interacting with the stake thereof; and the connecting member of any one of the game pieces partially or completely wraps around the stake protruding from any one of the planar surfaces and remains wrapped around the stake while the game piece lies on the planar surface; and one of the two weighted tossable objects of any one of the game pieces lies on the planar surface and the other of the two weighted tossable objects hangs off an edge of the planar surface and does not touch the ground surface supporting the game board;

calculating a score for the round based on the interactions between the game pieces and the game boards;

adding the score for the round to a total score; and performing a subsequent round when the total score is less than a predetermined total score or terminating the game when the total score reaches the predetermined total score.

8. The method of claim 7, wherein the game boards comprise a line that extends across the width of the planar surface and passes through the stake, the method further comprising scoring points if any one of the game pieces lands on the planar surface such that both weighted tossable objects thereof are past the line and remain on the planar surface without interacting with the stake.

9. The method of claim 7, further comprising allowing any one of the game pieces to remain on the game board until the end of the round but not counting the game piece toward the score if one of the two weighted tossable objects thereof lies on the planar surface and the other of the two weighted tossable objects hangs off an edge of the planar surface and touches the ground surface supporting the game board.

10. The method of claim 7, further comprising reducing the total score to a value of a previous total score calculated at the end of an immediately prior round if the total score is greater than the predetermined total score.

* * * * *